United States Patent [19]

Bue et al.

[11] B 3,999,245

[45] Dec. 28, 1976

[54] COUNTERBALANCE HINGE FOR PIVOTING LOADS

[75] Inventors: Richard C. Bue, Chaska; Phillip L. Gorsuch, Lindstrom, both of Minn.

[73] Assignee: Sico Incorporated, Minneapolis, Minn.

[22] Filed: July 10, 1975

[21] Appl. No.: 594,871

[44] Published under the second Trial Voluntary Protest Program on March 16, 1976 as document No. B 594,871.

[52] U.S. Cl. ..... 16/128 R; 5/136; 5/164 R; 5/166 R; 16/180

[51] Int. Cl.[2] ..... E05D 9/00

[58] Field of Search ..... 5/133, 164 R, 164 D, 5/174, 166 R, 166 B, 166 C, 136; 16/128 R, 137, 180, 186, 152, 153, 154, 160, DIG. 1, DIG. 36

[56] References Cited

UNITED STATES PATENTS

| | | | |
|---|---|---|---|
| 2,779,032 | 1/1957 | Van Der Sluys | 5/164 R |
| 3,550,167 | 12/1970 | Bennett | 5/164 R |
| 3,828,375 | 8/1974 | Driver | 5/136 X |

*Primary Examiner*—G. V. Larkin
*Attorney, Agent, or Firm*—Merchant, Gould, Smith, Edell, Welter & Schmidt

[57] ABSTRACT

An improved counterbalance hinge assembly has a bias spring and uniquely shaped cam for counterbalancing inherently nonlinear forces represented by pivoting loads such as fold up wall type beds, desks, and the like. A cable attached to the spring wraps progressively around the cam surface as the bed or other load is pulled out from the wall, thereby compressing the spring. The effective radius of the cam at a given point is designed in conjunction with the peripheral extent of the cam surface up to that point, to give the desired counterbalancing force as a function of the angular position of the load. In the preferred embodiment, the effective radius is thus smaller with the bed in its horizontal position than with the bed in its vertical position. Additionally, a small offset angle may be provided in the counterbalancing mechanism near the vertical position, to aid in moving the load to and from its stored position.

10 Claims, 6 Drawing Figures

FIG. 1
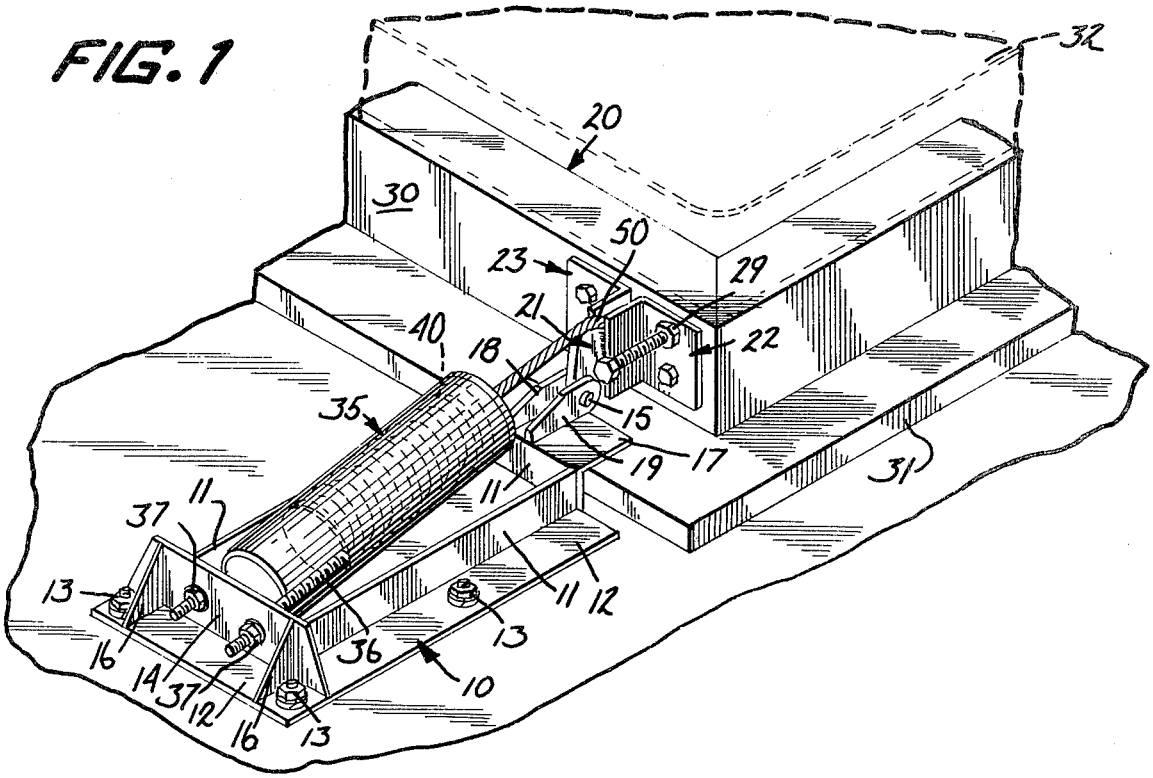
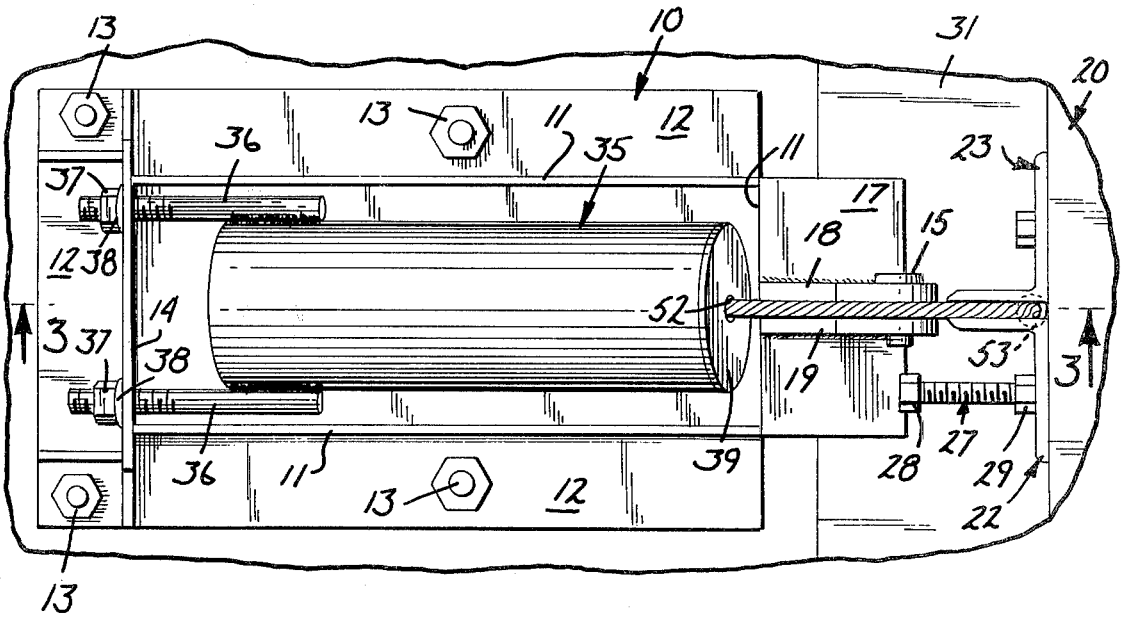
FIG. 2

FIG. 3
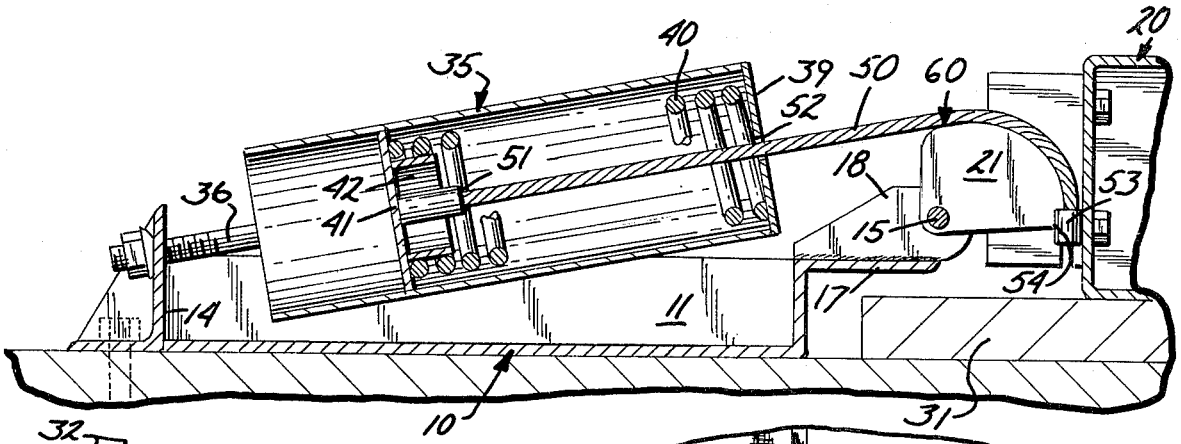
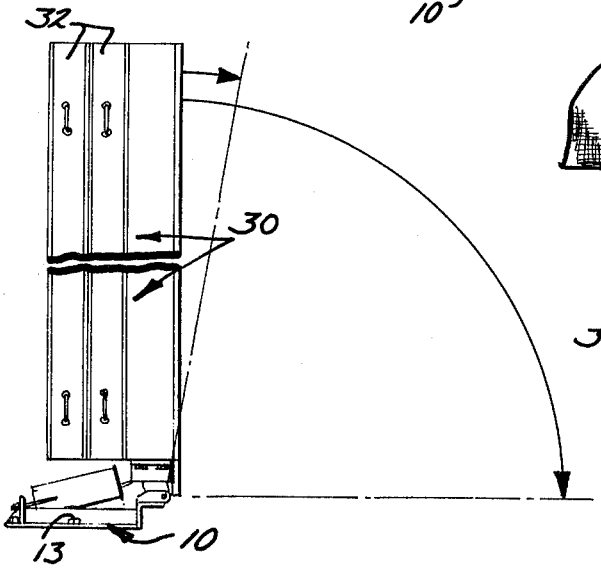
FIG. 5
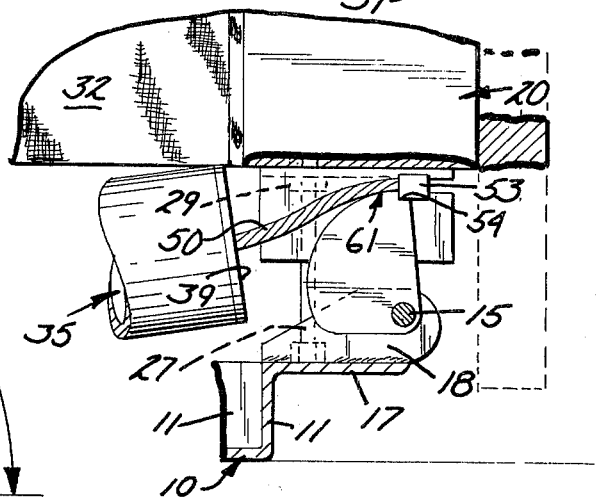
FIG. 4
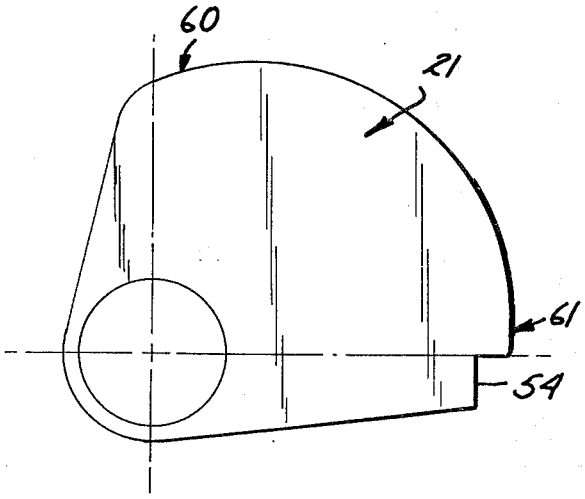
FIG. 6

COUNTERBALANCE HINGE FOR PIVOTING LOADS

BACKGROUND OF THE INVENTION

Folding wall type beds, desks, tables and other pieces of furniture are widely used in situations in which available space is at a premium. The bed or other piece of furniture is provided with hinges so that it can be pivoted upwards from its generally horizontal use position, to a generally vertical storage position adjacent a wall, or in a small closet placed in a wall for that purpose.

Because the weight involved in even a medium sized bed can be considerable, it has long been considered desirable to provide some type of counterbalance springs to make it easier for a person to move the bed between the in use and storage positions. It has also been long recognized that the spring bias applied as a torque about the bed pivot to oppose the weight of the bed is not a linear function of the position of the bed, but is in the nature of a sine function of the angular position of the bed. This of course is because the effective lever arm of the center of gravity of the bed about the pivot point increases sinusoidally as the bed is brought down from the vertical to the horizontal position.

The same situation exists with respect to all types of pivoting or fold up loads, including but not limited to, fold up desks, tables, work counters, loading ramps or doors hinged at the bottom, or any other member pivoted near its bottom for movement between a generally vertical to a generally horizontal position. For purposes of illustration, the present invention as disclosed herein is applied to a folding wall type bed, but it will be understood that the present invention is equally applicable to any of the pivoting type loads discussed above.

Numerous arrangements have been proposed in the prior art to match the essentially linear response of a spring to the inherently nonlinear counterbalancing force requirements of a fold up bed. One such prior art arrangement uses torsion bar springs as the main counterbalance for the bed. Additional springs and linkages are then used to counter the undersired effects of the torsion bars when the bed is near the horizontal, use position. This prior art structure involves the disadvantages of nonuniformity among manufactured torsion bars, limited range of adjustment to compensate for the nonuniformities and also for variations in bed weight, and a torsion bar breakage problem. This prior art structure also has the disadvantage of excessive cost and complexity, due to the necessity of the compensating springs and linkages.

Other prior art structures have proposed the use of a specially shaped cam to modify the force of the counterbalancing spring, as a function of the angular position of the bed. A spring is attached to one portion of the bed hinge or pivot and to the other portion of the hinge by means of a cable, belt or rope which passes around a cam surface which is fixed to move with the pivoting of the bed. In these prior art devices, the radius of the cam increases as the bed moves from the vertical to the horizontal position, because the portion of the weight of the bed to be overcome by lifting is greatest when the bed is near its horizontal position, diminishing to zero when the bed is in its vertical position. It was apparently thought that the large radius would give the spring the necessary leverage to handle the weight of the bed at its horizontal position, and that less leverage was needed as the bed approached the vertical position.

While the above theory for the shape of the cam appears reasonable at first glance, in actual practice we have found the opposite to be true; namely that the effective radius with the bed in its horizontal position should be less than the effective radius with the bed in its vertical position.

The reason for this seeming contradiction is that the prior art structures referred to above fail to take into account the effect on the degree of tension or compression of the spring due to the shape of the cam itself. It is thus necessary to consider not only the effective radius of the cam at a given point, but the tension or compression of the spring at that same point, which of course determines the force applied by the spring. But the compression or tension of the spring is itself a function of the total path length or peripheral length over the surface of the cam from the start up to the point in question. It is this path length factor which was apparently overlooked in the prior art devices discussed above.

Thus, the problem is not merely one of multiplying the spring force, assumed to be more or less constant, by the variable effective radius of the cam. Instead, if excessive long springs are to be avoided, which would lead to greater complexity, expense, and space requirements, it must be recognized that not only is the effective lever arm of the cam a function of its angular position, but the spring displacement and hence force developed is also a function of the angular position of the cam, since the displacement of the spring is determined by the peripheral length around the surface of the cam.

SUMMARY OF THE INVENTION

The present invention thus provides a counterbalanced folding hinge assembly which is compact in configuration, low in cost, and does not require additional compensating springs to achieve the desired counterbalancing function. According to the present invention, a base portion and a movable portion of the hinge frame assembly are pivoted together for allowing the bed or other load which is attached to the movable frame portion to be pivoted between a vertical storage position and a horizontal use position. Counterbalance means are included and interconnected between the two frame portions for applying the necessary bias. The counterbalance means includes a spring operatively engaging one of the frame members, a cam attached to the other of the frame members and a cable or other flexible force transmitting member interconnecting the spring and the other of the hinge frame members, and passing over and around the cam surface to provide a variable effective radius and leverage arm for the spring according to the position of the hinge. Because of the unique cam provided by the present invention, which is designed in consideration of peripheral length of the cam surface as well as the cam effective radius, a smaller effective radius is provided when the load is in its horizontal position, and a larger effective radius when the load is in its vertical or stored position.

Means are further provided for providing an offset angle so that the counterbalancing spring is not engaged as the load is pulled away from its vertical position, until the center of gravity of the load reaches a vertical line through the pivot point, thus aiding operation of the device.

According to a further aspect of the invention, adjustment means are provided for adjusting the hinge assembly to different load weights.

BRIEF DESCRIPTION OF THE DRAWINGS

In the drawing, FIG. 1 is a view in perspective of the hinge assembly according to the present invention;

FIG. 2 is a plan view of the hinge assembly of FIG. 1;

FIG. 3 is a view in side elevation of the hinge assembly of FIG. 1, portions thereof being broken away for clarity;

FIG. 4 is a detailed view similar to FIG. 3, but with the load shown pivoted to its vertical position;

FIG. 5 is a diagrammatic view showing movement of the bed or other load from the vertical to the horizontal position; and FIG. 6 shows the cam according to the present invention.

DESCRIPTION OF THE PREFERRED EMBODIMENT

Referring now to the drawings, the hinge assembly comprises a base frame member 10 and a movable frame member 20, which are pivoted together by a hinge pin 15. Base frame member 10 is adapted to be rigidly secured to the floor, or to any suitable reinforcing member which may be installed on the floor. The base frame member preferably has vertical side rail portions 11 for strength and rigidity, and horizontal flange portions 12 which are used for securing the hinge assembly to the floor, by means of bolt and nut assemblies 13. Base frame member 10 also includes a vertical end plate 14, and suitable braces 16, which interconnect flange portion 12 and vertical end plate 14. Base frame member 10 can be cast, or can be welded up from individual angle iron members, as may be desired.

At the forward end of base frame member 10 there is provided a shelf portion 17, which in the embodiment shown is parallel to the floor, but spaced apart therefrom. A pair of guide plates 18, 19 are welded to shelf portion 17. Guide plates 18 and 19 are mounted in a vertical orientation, and spaced apart from each other so as to acommodate the cam member 21. Hinge pin 15 passes through guide plates 18, 19, and through an opening provided in cam member 21, so that the cam member is free to pivot thereabout.

The movable frame member 20 comprises that portion of the hinge including cam 21 which pivots with the bed or other load, about the hinge pin 15. In the embodiment shown, the movable frame member comprises a pair of angle members 22, 23 which are welded to the sides of cam member 21. Alternatively, cam 21 and angle members 22, 23 could be made from a single casting, if desired.

The frame of the bed or other load, 30, is bolted to the members 22, 23 of the movable frame member 20. A panel 31 may be attached to the bottom of the bed frame 30, so that when the assembly is installed in a small closet or alcove, the panel 31 will close off the alcove by providing a surface contiguous with the wall. A mattress and other bedding 32 is attached to bed frame 30 for pivoting therewith.

A stop member is provided, which comprises a bolt 27 which is threaded into a tapped hole provided in angle member 22. When the bed is moved to its vertical position, the head 28 of bolt 27 engages the shelf portion 17 of the base frame member, as indicated in broken lines in FIG. 4. This serves to limit the vertical motion of the bed. The stop is adjustable by turning head 28 of the bolt to thread it further into or out from angle member 22, and lock nut 29 may then be used to lock the stop in the desired position.

A cylindrical shaped spring housing 35 has a pair of anchor bolts 36 welded to the outside periphery thereof, for securing the spring housing to the base frame member, and for providing adjustment therefor. The anchor bolts pass through holes provided in the vertical end plate 14, and are secured by nuts 37 and spherical washers 38, which aid in allowing slight adjustments in the position of spring housing 35 as the hinge is pivoted. A coil spring 40 is provided within spring housing 35. One end of spring 40 butts against the closed end 39 of housing 35. The other end of spring 40 is engaged by a washer 41. The back side of washer 41 has a cylindrical reinforcing member 42 welded thereto. Member 42 serves to strengthen washer 41, and also serves to help locate and position the washer with respect to the spring 40, since the outside diameter of reinforcing member 42 is selected to be slightly less than the inside diameter of the coil spring 40.

Cable 50 is attached by any suitable means to the washer 41, at 51. The cable passes through the inside of coil spring 40, and through a central aperture 52 provided in end 39 of the spring housing. Cable 50 then wraps over and around cam member 21, where its other end engages the movable frame member by means of an end fitting 53 of the cable, which engages a matching notch 54 provided in the edge of cam 21. The cable is also held in place on the cam surface by angle members 22, 23 on either side of the cam. This is best seen in FIG. 3, in which member 22 is omitted for purposes of clarity.

With the bed or other load in its horizontal position, as shown in FIGS. 1, 2 and 3, cable 50 is pulled around cam 21, causing washer 41 to compress spring 40. In this position, spring 40 provides a counterbalancing moment around pivot 15 which is determined by the degree of displacement or compression of spring 40, and the effective radius arm at that point which extends from cable contact point 60 to the center of the pivot point 15.

When the bed is moved to its vertical position, cam 21 is rotated counterclockwise as seen in FIGS. 3 and 4, allowing spring 42 to release its compression. As the bed nears the top of its travel, the spring applies its counterbalancing force through an effective leverage determined by the radius from cable contact point 61 to the center of the pivot point 15. As can be seen in FIGS. 3, 4 and 5, the effective radius at contact point 60 (with bed horizontal) is shorter than the effective radius arm at contact point 61 (representing bed in vertical position). It will also be appreciated that the total amount of displacement, or compression of spring 40, as determined by the extent of travel of the washer 41 in compressing the spring, is equal to the total path length around the periphery of the cam surface, from contact point 60 to contact point 61.

The required moment to be applied around the pivot point in order to counterbalance the load represented by the folding bed can be expressed as $Wx \sin \alpha$, where $W$ is the weight of the bed, $x$ is the distance from the pivot point to the center of gravity of the bed, and $\alpha$ is the angle made by the bed with respect to the wall. Thus, the required counterbalancing moment increases as the bed is drawn down from the wall.

The force provided by a spring is $sd$, where $s$ is the spring rate, usually expressed in pounds per inch, and $d$ is the displacement (either compression or tension) of the spring. The counterbalancing torque provided by the spring in the present invention is the spring force multiplied by the effective radius arm, $r(\alpha)$, which is a function of the angular position. The important point to observe is that the displacement $d$ of spring 40 is also a function of the angular position of the bed, and more specifically, of the effective peripheral path length around the surface of the cam from the initial contact point to the point in question. Thus, the displacement $d$ of the spring is in general, a complex function $d(\alpha)$.

At any given angular position of the bed, the effective radius $r(\alpha)$ is the distance from the hinge point to the cable contact point, and the displacement $d(\alpha)$ is the peripheral path length from the initial cable contact point 61, around the surface of the cam to the instant cable contact point. Thus, the cam is designed, both with respect to effective radius, and with respect to peripheral path length, so that the following relationship is approximated.

$$sd(\alpha)r(\alpha) = Wx \sin\alpha$$

With the aid of the above equation, the cam can be designed by a successive approximation method. For a given load weight and spring rate, the necessary cam radius can be designed at a first design point, for example, 10° off the vertical position. The radius can then tentatively be calculated for the next design point, for example 20°. The resulting peripheral length can then be graphically determined, and based upon this, it will be necessary to recompute the second design point radius. This in turn affects the peripheral length which must be redetermined. Each successive approximation approaches closer to the correct values, and after several such steps, the correct values can be determined to any desired degree of accuracy. The procedure is then repeated for each succeeding design point around the face of the cam.

Although the drawings show only one hinge assembly, in practice a pair of such assemblies would normally be required for a given installation, and the counterbalancing effect of both assemblies must be taken into account in designing the necessary spring constants and other design parameters.

An additional factor to be considered in designing the hinge assembly is the fact that in many cases it is desirable to place the pivot point relatively close to the floor and near the finished panel 31, as shown in FIG. 5. Thus, with many loads the center of gravity of the load tends to fall to the left of a vertical line through the hinge point, as seen in FIG. 5. This is desirable in that the weight of the load, being slightly over the center of the pivot point serves to hold the bed in the stored position, without the necessity for any latches. When it is desired to pull the bed down to its horizontal position, the operator must initially overcome this slight over center effect of the weight of the bed. It is therefore desirable that the counterbalancing spring, which ordinarily tends to urge the bed towards the wall, not come into play until this initial travel of the bed is reached.

Accordingly, an initial offset angle is built into the present counterbalanced hinge assembly. Line 65 in FIG. 5 represents the offset position of the bed at which point the center of gravity of the bed is centered over the hinge pivot point 15, and the offset angle is the angle of line 65 with respect to the vertical. In typical installations, the offset angle may be approximately 10°.

Since the offset angle will vary from one application or installation to another, once it is calculated the angular relationship between cam 21 and the rest of the movable frame member 20 should be adjusted accordingly, during the manufacturing process. Thus cam 21 should be out of phase with respect to the bed, by an angle equal to the offset angle. Thus cam 21 will be at its initial, or 0° starting position with respect to the contact of cable 50, at such time that the bed is in its offset position, 65 in FIG. 5. Stated another way, the face 31 of the bed leads the cam by the offset angle; and the cam is zero referenced according to the position at which the center of gravity of the bed is vertically over the pivot point.

If the center of gravity of the bed or other load were changed, as for example by the addition of a heavy mirror on the finished surface 31, in theory it should be necessary to change the angular relationship between cam 21 and the bed to reflect the change in the offset angle. Fortunately however, in practice it is possible to accommodate a relatively large change in effective center of gravity positions for the load simply by adjusting nuts 37 which of course shift the spring housing 35 right or left as necessary. Similarly, with regard to changes in the weight of the bed or load, the spring rate s should be changed to reflect the new weight $W$. In fact, this may well be done so that the same hinge assembly can be used on different models of beds having different weights. But for a surprisingly large variation in the weight of the bed, such as may be caused by including a mirror or other accessories, the effect of the additional weight can be adequately compensated for again by adjustment of nut 37.

In practice, the bed is put to its horizontal position, and the position of the spring housing is then adjusted to give the desired hold down weight on the bed, which may be approximately 5 pounds, for example. This insures that the bed will remain positively down when it is intended to be in its in use position. The bed will then be adequately counterbalanced throughout its whole range, even though the effect of adjusting spring housing 35 will be to begin to engage the spring a few degrees before or after the offset position. Such minor adjustments will not degrade the counterbalancing performance of the hinge assembly, but will permit adjustment to accept a wide variety in load weight and center of gravity position.

It will be appreciated that since the system is preferably designed to reduce the spring force to zero at the offset angle position, further travel of the bed to its stored or vertical position will result in a slackening of cable 50, as indicated in FIGS. 4 and 5. However, upon pulling the bed downward, the slack is taken up when the bed reaches a point near the offset position, depending upon the fine adjustment of nuts 37.

While the equation and design procedure discussed above will lead to a counterbalance hinge assembly having perfect counterbalance throughout the travel of the bed, from the offset position down to horizontal, in practice it may be desirable to deviate slightly from a cam design for perfect balance. Thus in a preferred embodiment, the cam is designed to balance perfectly during its mid range, from about 20° to about 65 °. However, from the 0° point on the cam (point 61 in FIG. 6) to approximately 20° on the cam, slightly less radius may be provided than that required for perfect balance. This provides the advantage that, once moved past the offset position, the bed will begin to slowly come down by itself, but will stop when the mid range of perfect balance is reached. By the same token, when the bed is lifted to its vertical position, the less than required counterbalance in the 0° to 20° range will help retard the acceleration of the bed previously induced by the lifting operation, so that the bed slows and does not slam into the wall.

Similarly, from approximately 65° to the end of the cam, corresponding to the bed being at or near its horizontal position, it may be desired to again provide a slightly reduced radius, so as to provide slightly less than a perfect counterbalancing force. This helps insure that the bed will be positively kept on the floor. It will be appreciated that these ranges of angles are only approximate, and can be varied as desired. Similarly, the amount by which the radius may be reduced in these areas may be adjusted in consideration of the desired extent of the effects noted above.

Although these slight reductions in the cam radius in two zones theoretically affect the path length of the cam, in practice, the necessary radius reductions are very slight, and it has been found that the effects of change in path length are negligible, thus simplifying the design procedure.

By way of example, a preferred embodiment of the present invention was made according to the configuration of the hinge assembly shown in the drawings, and with the cam having radius values according to the following table.

| CAM ANGLE (DEGREES) | RADIUS (INCHES) |
|---|---|
| 0 | 2.53 |
| 10 | 2.60 |
| 20 | 2.62 |
| 30 | 2.60 |
| 40 | 2.44 |
| 50 | 2.44 |
| 60 | 2.30 |
| 70 | 2.13 |
| 80 | 1.96 |

The values listed above correspond to the modified form of the invention in which perfect counterbalancing is provided in the mid range, with less than perfect counterbalancing when the bed is near its vertical and horizontal positions, so as to aid in pivoting the bed as discussed above. The angles in the above table correspond to angular positions on the cam, with the zero degree reference point corresponding to contact point 61 on the cam, as shown in FIG. 6. This example involves a 10° offset angle in the bed. Accordingly, no value was calculated for the 90° position on the cam, since the 80° position on the cam corresponded to the horizontal position of the bed.

Numerous variations on the overall size and shape of the cam, and the configuration of the hinge assembly are possible within the scope of the present invention. For example, it would be possible to provide two or more springs operating in parallel in place of the single spring shown in the drawings, if needed. It is also possible to interchange the cam and spring, so that the spring engages the portion por;tion of the frame, while the cam is attached to the base portion. In either case, the operating principle is the same.

We claim:

1. A counterbalanced folding hinge assembly comprising:

a. a base frame member for attachment to a floor;

b. a movable frame member for attachment to a load;

c. means pivotally mounting said movable frame member to said base frame member to permit pivoting of the load between vertical and horizontal positions;

d. counterbalance means interconnected between said base frame and movable frame for applying a bias thereto, said counterbalance means comprising:

1. a spring having one end operatively engaging one of said frame members;

2. means defining a cam surface attached to the other of said frame members;

3. a cable interconnecting the other end of said spring and said other of said frame members and engaging said cam surface, said cam surface configured to provide a large effective radius when said movable frame is in the vertical load position, and a small effective radius when said movable frame is in its horizontal load position.

2. A counterbalanced folding hinge assembly according to claim 1 wherein said spring is held in compression by engagement by said frame member and said cable.

3. A counterbalanced folding hinge assembly according to claim 1 wherein said spring is held in tension between said frame member and said cable.

4. A counterbalanced folding hinge assembly according to claim 1 wherein said cam is attached to said movable frame member, and wherein said spring has one end operatively engaging said base frame member.

5. A counterbalanced folding hinge assembly according to claim 1 wherein said spring has one end engaging said movable frame member, and wherein said cam is attached to said base frame member.

6. A counterbalanced folding hinge assembly, comprising:

a. a base frame member for attachment to a floor;

b. a movable frame member for attachment to a load;

c. means pivotally mounting said movable frame member to said base frame member to permit pivoting of the load through a variable angle between substantially vertical and horizontal positions;

d. means defining a cam surface, said means attached to said movable frame member for pivotal movement therewith;

e. a counterbalance spring;

f. spring engagement means connected to said base frame member and operatively engaging said counterbalance spring;

g. a cable operatively engaging said spring and said movable frame member for transmitting force from said spring to said movable frame member, said cable positioned to pass around said cam surface; and h. said cam surface configured such that the product of its effective radius about the pivot point and its peripheral path length is approximately proportional to the sine function of the variable angle of the load.

7. A counterbalanced folding hinge assembly according to claim 6 wherein said counterbalance spring comprises a coil spring held in compression by engagement by said cable and said spring engagement means.

8. A counterbalanced folding hinge assembly according to claim 7 further including means for adjusting the position of said spring engagement means substantially axially of said cable whereby to adjust said hinge assembly for variations in the load.

9. A counterbalanced folding hinge assembly according to claim 6 wherein said cam surface is configured with respect to the sine function of the angle of the load measured with reference to an offset position of the load in which the center of gravity of the load is vertically over the pivot point of the hinge.

10. A counterbalanced folding hinge assembly according to claim 6 wherein the product of the effective radius of the cam and its peripheral path length is slightly less than the sine function of the variable angle of the load for values of the angle near the vertical and horizontal positions of said load, whereby to provide slightly less than full counerbalancing near the vertical and horizontal positions as an aid in pivoting the load.

* * * * *

UNITED STATES PATENT AND TRADEMARK OFFICE

CERTIFICATE OF CORRECTION

PATENT NO. : 3,999,245

DATED : December 28, 1976

INVENTOR(S) : Richard C. Bue and Phillip L. Gorsuch

It is certified that error appears in the above-identified patent and that said Letters Patent are hereby corrected as shown below:

Column 7, line 66, the word "por;tion" should be deleted.

Column 10, line 8, the word "counerbalancing" should be changed to the word --counterbalancing--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*